US005720083A

United States Patent [19]

Leduc et al.

[11] Patent Number: 5,720,083

[45] Date of Patent: Feb. 24, 1998

[54] METHOD FOR DECORTICATING PLANT MATERIAL

[75] Inventors: Philip J. Leduc; Leslie G. Hill; David H. Kelly, all of Humboldt; Mark A. Stratton, Saskatoon, all of Canada

[73] Assignee: Durafibre Inc., Canora, Canada

[21] Appl. No.: 685,453

[22] Filed: Jul. 19, 1996

[51] Int. Cl.[6] ..... D01B 1/22

[52] U.S. Cl. ..... 19/30; 19/24; 19/5 R; 19/5 A

[58] Field of Search ..... 19/5 A, 5 R, 8, 19/10, 11, 21, 24, 28, 30, 33, 34, 6

[56] References Cited

U.S. PATENT DOCUMENTS

| | | | |
|---|---|---|---|
| Re. 23,044 | 10/1948 | Brooks | 19/67 |
| 1,021,269 | 3/1912 | Schlichten | 19/10 |
| 2,264,236 | 11/1941 | Bokum et al. | 19/24 |
| 2,418,694 | 4/1947 | Brooks | 19/39 |
| 2,741,894 | 4/1956 | Schulze | 57/164 |
| 2,746,082 | 5/1956 | Thompson et al. | 19/10 |
| 5,031,278 | 7/1991 | Demuth et al. | 19/98 |
| 5,465,464 | 11/1995 | Chen et al. | 19/24 |

FOREIGN PATENT DOCUMENTS

| | | |
|---|---|---|
| 834983 | 4/1976 | Belgium . |
| 645221 | 7/1962 | Canada . |
| 836802 | 3/1970 | Canada . |
| 965214 | 4/1975 | Canada . |
| 1093412 | 1/1981 | Canada . |
| 107 603 A1 | 5/1984 | European Pat. Off. . |
| 2 651 800 | 3/1991 | France . |
| 2 676 754 | 11/1992 | France . |
| 39 23 498 A1 | 1/1991 | Germany . |
| 41 19 749 A1 | 12/1992 | Germany . |
| 97 899 | 10/1989 | Romania . |
| 1107781 A | 8/1984 | U.S.S.R. . |
| 1199835 A | 12/1985 | U.S.S.R. . |
| 1641902 A1 | 4/1991 | U.S.S.R. . |
| 92/13985 | 8/1992 | WIPO . |

*Primary Examiner*—C. D. Crowder
*Assistant Examiner*—Larry D. Worell, Jr.
*Attorney, Agent, or Firm*—Fitch, Even, Tabin & Flannery

[57] ABSTRACT

A method for separating woody material from plant fibers is disclosed which includes the provision of a plurality of woody material bending regions with the plant material being fed to a first and then a second one of the bending regions as bending and pulling surfaces are moved through the bending regions. The bending and pulling surfaces move through the regions at different operating speeds so that the bending and pulling surfaces in adjacent bending regions will pull on the plant material to separate the fibers from the woody material. As the bending and pulling surfaces primarily impart a pulling or stripping force on the fiber along its length where the fiber has its most strength, the woody material can be dislodged and stripped away lengthwise with minimal damage or breakage of the fiber. The step of providing bending regions can include the step of providing first and second sets of fluted rollers having bending and pulling radially extending flute surfaces. The plant material is fed to the first bending region between the first set of fluted rollers and then the second bending region between the second set of fluted rollers. Preferably, a third bending region is also provided and the bending and pulling flutes are caused to move through the first, second and third regions at progressively increasing operating speeds.

12 Claims, 6 Drawing Sheets

METHOD FOR DECORTICATING PLANT MATERIAL

FIELD OF THE INVENTION

The invention relates to a method for separating woody material from plant fibers and, more particularly, to a method for decorticating shive from flax straw to yield flax fibers by subjecting the flax straw to processing sections, each having sets of fluted rollers which are rotated at different rotation rates from adjacent sets of rollers to bend and pull the shive and thereby strip shive from the flax fibers.

BACKGROUND OF THE INVENTION

Various methods of decorticating flax straw, that is, separating the woody shive material from the flax plant fibers, have been proposed. Apart from retting and chemical treatment processes, most systems for mechanically working flax straw rely on some sort of scutching or a beating or flailing action as the primary mechanism to break up the woody material and dislodge the same from associated fibers. Examples of machines utilizing scutching or beating action in removing shive are disclosed in U.S. Pat. Nos. 2,418,694 and 2,741,894.

The problem with beating flax straw to break loose the shive material is that the beating action can also damage or break the fibers and thereby shorten the fibers separated from the shive. In many applications for these fibers, long fibers can be necessary for strength purposes such as in papermaking, preparation of fiberboard-types of materials, production of textiles, and reinforcing other fibers, plastic or composite material, and thus the shorter fibers produced by prior methods of decortication are undesirable. In addition to longer fibers, it is also economically desirable to be able to process high rates of flax straw through decorticating machines with relatively low power requirements.

SUMMARY OF THE INVENTION

According to the invention, a method for separating woody material from plant fibers is disclosed which includes the provision of a plurality of woody material bending regions with the plant material being fed to a first and then a second one of the bending regions as bending and pulling surfaces are moved through the bending regions. The bending and pulling surfaces move through the regions at different operating speeds so that the bending and pulling surfaces in adjacent bending regions will pull on the plant material to separate the fibers from the woody material. As the bending and pulling surfaces primarily impart a pulling or stripping force on the fiber along its length where the fiber has its most strength, the woody material can be dislodged and stripped away lengthwise with minimal damage or breakage of the fiber. In addition, if the friction of being pulled over the bending and pulling surfaces becomes too large at the removal point of the woody material, the woody material will overcome the pulling force and the plant material will not be pulled and will cease its relative motion and move between the bending and pulling surfaces in a region until it is once again to a point where it can be pulled and removal of woody material can be accomplished. In this manner, damage such as by breaking of the plant fiber is limited.

The step of providing bending regions may include the step of providing first and second sets of fluted rollers having bending and pulling radially extending flute surfaces. The plant material is fed to the first bending region between the first set of fluted rollers and then the second bending region between the second set of fluted rollers. The method utilizing fluted rollers allows very high flow rates of plant material to be processed with relatively low power requirements compared to processes which primarily rely on mechanically working and beating or flailing of the plant material to break loose the woody material.

The step of separating fibers from woody material may include the step of causing the plant to undergo back and forth bending and pulling as the bending and pulling flute surfaces engage the plant material as they move through their respective bending regions to crimp and break woody material and to strip the woody material from the plant fibers. By back and forth bending of the woody material, areas of weakness are created which when subjected to pulling forces will allow the woody material to be stripped from the plant fibers.

The method may further include the steps of feeding plant material to a third one of the bending regions after it is moved through the second bending region and causing the third region bending and pulling surfaces to move through the third region at an operating speed different than the operating speed of the first and second region bending and pulling surfaces. Preferably, the bending and pulling surfaces are caused to move through the first, second and third bending regions at progressively increasing operating speeds. In this manner, the plant material will be pulled between the bending regions such as by the second region bending and pulling surfaces from the first region and by the third region bending and pulling surfaces from the second region to strip the woody material from the plant fibers.

Preferably, the first, second and third bending regions are provided together as a first plant material processing section with additional processing sections being provided for feeding plant material successively to each of the processing sections. The plant material can be fed to five processing sections at a rate of at least 10,000 pounds per hour and yielding as fiber output from the final processing section in the range of 55–60% of fiber purity. Thus, the method of the present invention has increased processing rates while still yielding relatively high percentages of fiber as output over prior decorticating methods.

Another aspect of the invention is a method for decorticating shive from flax straw to yield flax fibers, including the steps of providing sets of upper and lower fluted rollers, with the upper and lower rollers arranged in a set to provide an area therebetween where the flutes of the upper rollers overlap with the flutes of the lower rollers as the rollers are rotated, rotating sets of fluted rollers at different predetermined rotation rates, feeding flax straw to the flute overlap areas between the upper and lower rollers, bending the shive of the flax in the fluted overlap areas by engagement with the roller flutes while limiting damage to the flax fibers, and pulling bent shive from one set of rollers to the next as a result of the different rotation rates of the roller sets to strip the shive from the flax and produce flax fibers.

Preferably, the step of providing sets of fluted rollers includes providing a first set of feed rollers, a second set of intermediate feed rollers and a third set of high speed rollers with the flax being fed successively from the first set to the second set to the third set of rollers. The rotating step may include rotating the feed rollers at a rate of approximately 60–110 revolutions per minute (rpm), the intermediate speed rollers at a rate of approximately 1000–1750 rpm, and the high speed rollers at a rate of approximately 2000–3500 rpm.

The method may include the step of providing a set of upper and lower crush rollers, feeding the flax to the crush rollers, producing a thin mat of compressed flax, and feeding the thin flax mat to the first set of rollers.

The method may include the steps of providing removable flutes on the fluted rollers and removing worn flutes on the rollers and replacing the removed flutes with new flutes.

DETAILED DESCRIPTION OF THE PREFERRED EMBODIMENT

Figure 1:
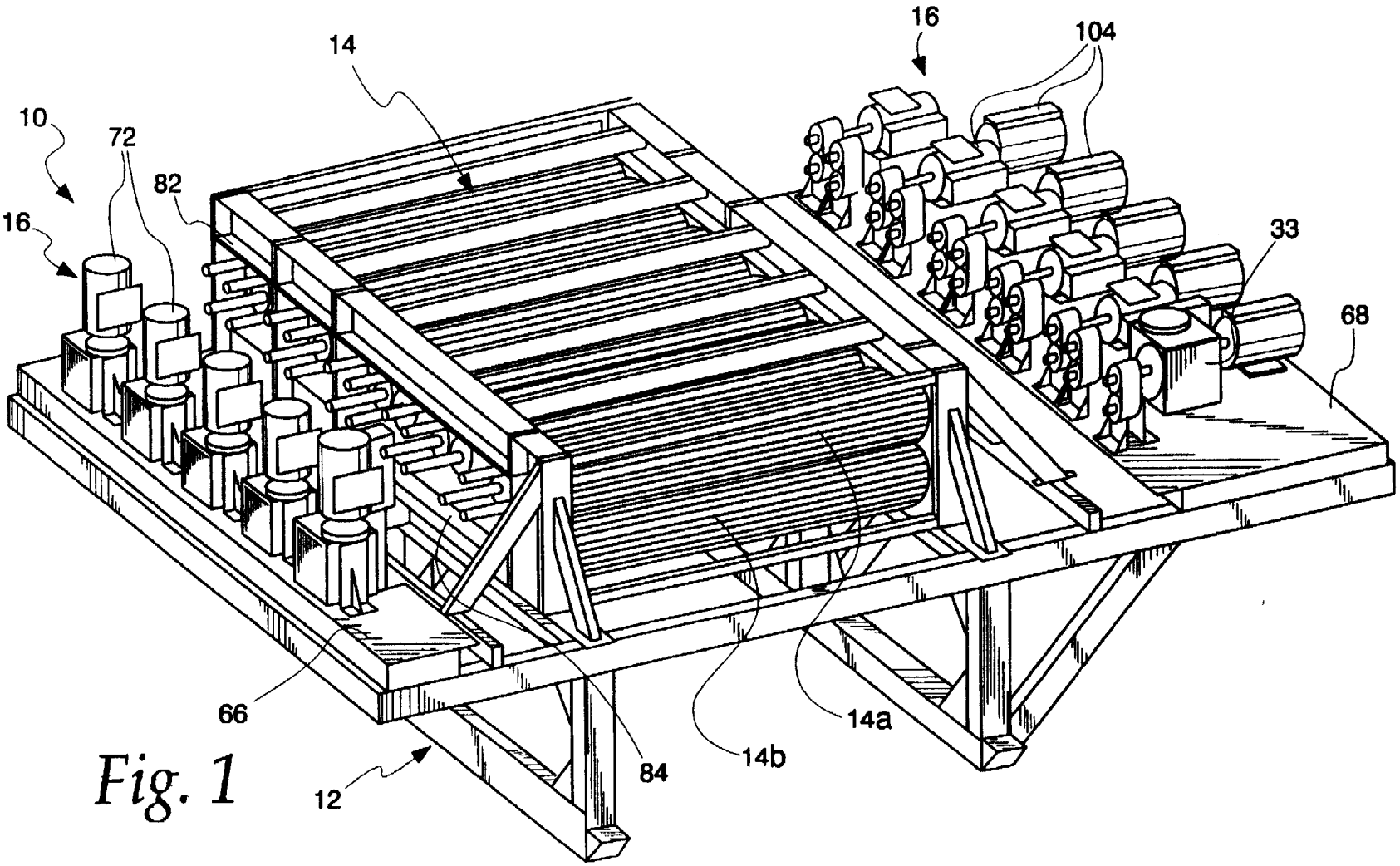
FIG. 1 is a perspective view of a machine which can be used to carry out the method of the present invention and shows a machine frame for supporting sets of fluted roller assemblies through which plant material travels.

A machine 10 is depicted in FIG. 1 which can carry out the method of separating woody material from plant fibers in accordance with the present invention. The machine 10 includes a framework 12 for supporting sets of roller assemblies 14 and their associated drives 16.

Figure 2:
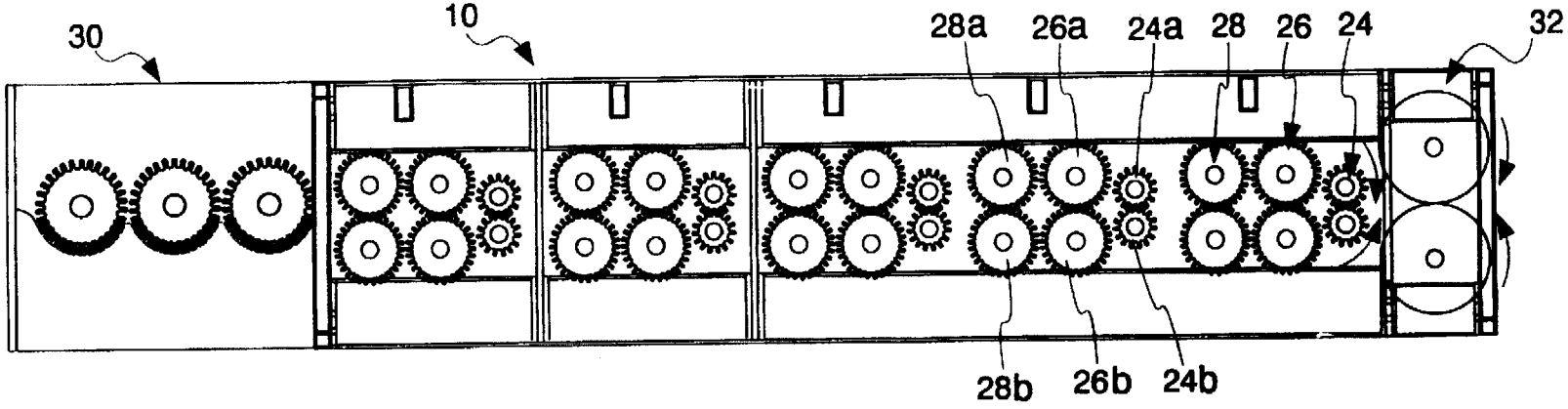
FIG. 2 is a side elevational view of the machine of FIG. 1 including an optional scutching unit provided at the outlet end of the machine.
Figure 3:
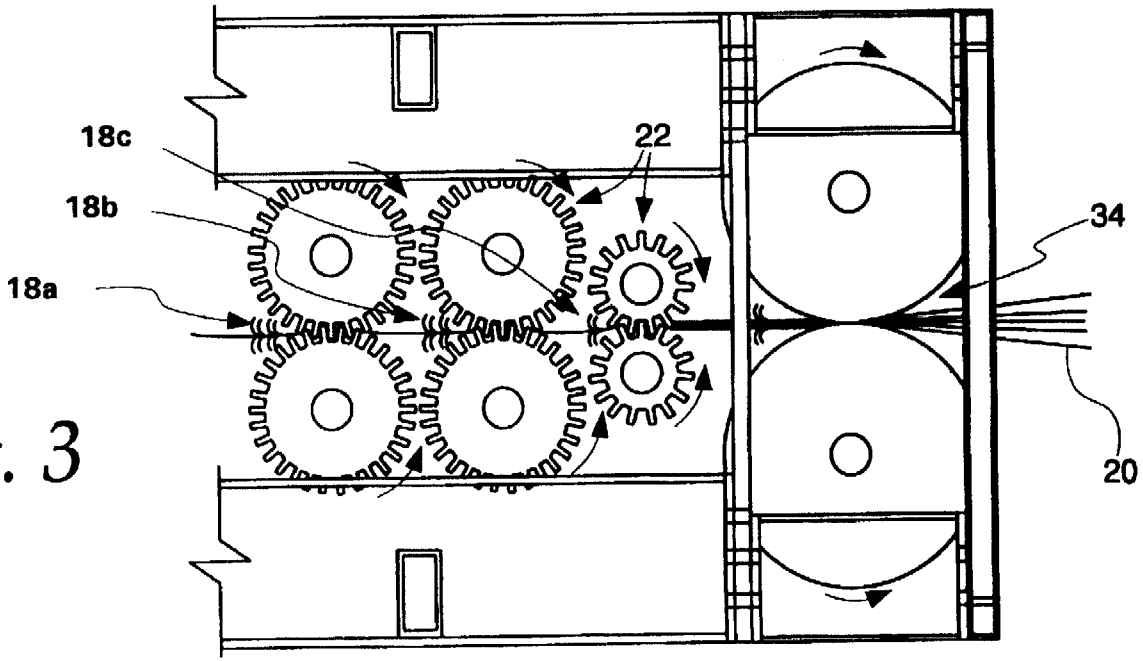
FIG. 3 is an enlarged fragmentary view of optional crush feed rollers and the first processing section of FIG. 2.
Figure 4:
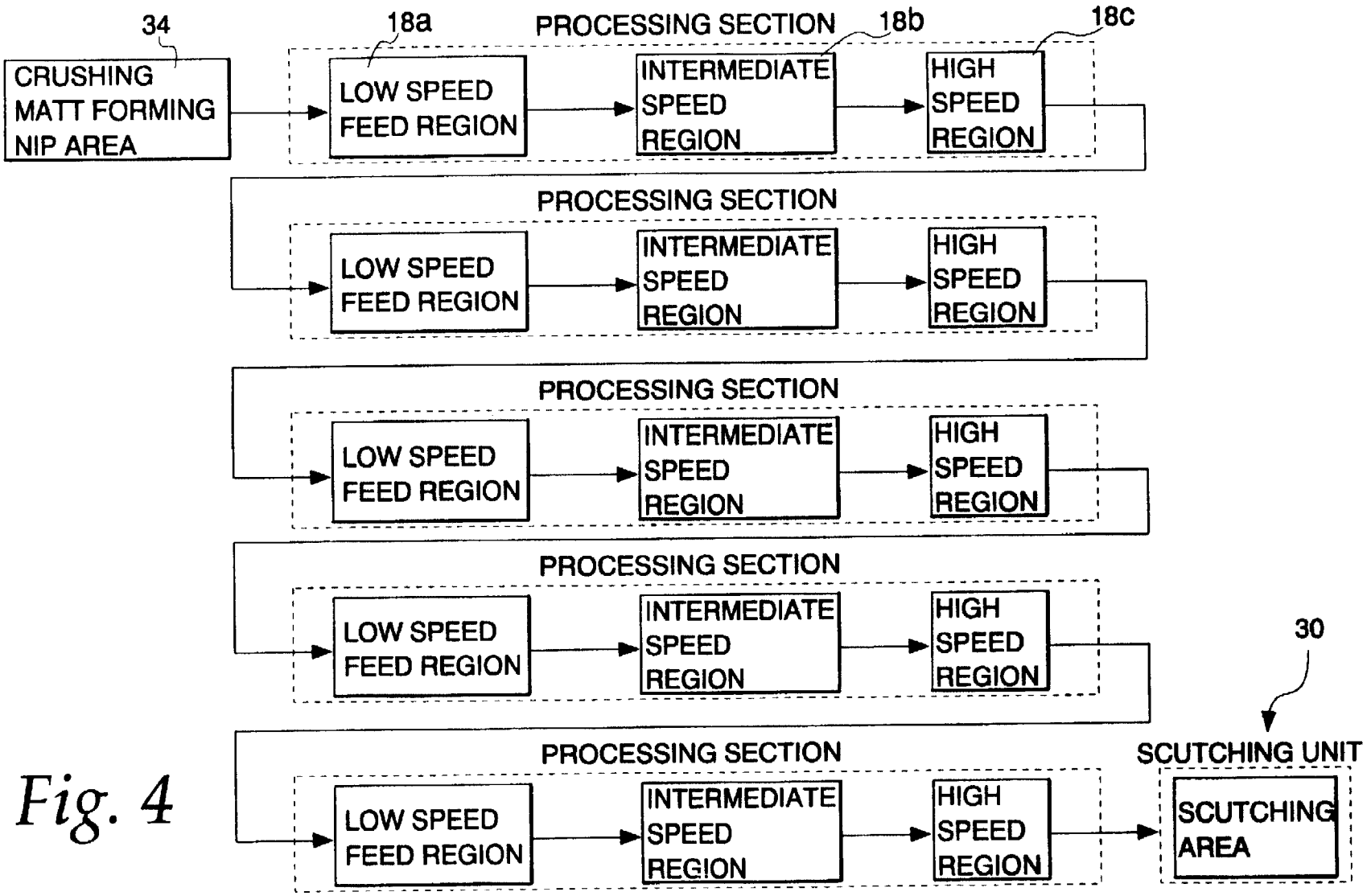
FIG. 4 is a block diagram of the method according to the present invention where the plant material is first fed to a crushing area and then to a plurality of processing sections each having varying speed sets of rollers and then to the scutching area.

Referring to FIGS. 2–4, the method in accordance with the invention includes arranging the roller assemblies 14 in sets so that they define the woody material bending regions 18 between upper and lower rollers **14*a* and 14*b* in a set. The plant material 20 is then fed through these bending regions 18, as best seen in FIG. 3. The method herein utilizing the machine 10** is ideally suited for decorticating flax straw to yield flax fibers, although it will be recognized that other plant material from which it is desired to separate woody material from the plant fibers can also be processed by way of the method of the present invention.

To separate the woody material from the plant fibers, the roller assemblies 14 are provided with bending or pulling surfaces or flutes 22 thereon. The rollers 14 in a set are arranged so that the bending and pulling surfaces 22 move through the bending regions 18 in an overlapping manner, thereby bending the plant material 20 in the bending region 18. The bending and pulling surfaces 22 are caused to move through their respective bending regions 18 at different predetermined operating speeds so that the plant material 20 is pulled from the slower moving sets of roller assemblies 14 to the faster moving roller sets. In this fashion, the woody material on the exterior of the plant material 20 is bent creating areas of weakness with the woody material then being gripped by the surfaces 22 and pulled from one set of rollers 14 to the next to strip the woody material off of the fibers leaving a relatively long length of unbroken fibers as the final product. This is a significant improvement over prior methods which mechanically work the straw, such as by beating and flailing the straw to break loose the shive material as in those processes the fiber length was typically much shorter than that produced by way of the present method. In addition, the present method does not require any pretreatment of the flax straw such as by field retting and has been found to work well with straw in a wide variety of conditions.

More particularly, the sets of roller assemblies 14 include a set of low speed, smaller diameter feed rollers 24, intermediate speed, larger diameter rollers 26 and high speed large diameter rollers 28 which make up a single processing section of the machine 10. Preferably, the intermediate speed rollers 26 and the high speed rollers 28 are of substantially equal diameters. As can be seen in FIG. 2, five such processing sections are provided in the machine 10.

As the flax straw material 20 is fed from one processing section to the next, shive is progressively removed from the fiber by the bending and stripping action, as previously described. The woody shive falls out of the machine 10 between the processing sections and is conveyed away with the fiber being carried forward to the end of the machine 10 and out from the last processing section. With the decorticating method herein, the percentage of fiber obtained from flax straw has been found to be in the range of 55 to 60 percent fiber purity. To obtain even higher percentages of fiber, the fiber material from the machine 10 can then be fed to a scutching unit 30 which gently mechanically works the fibers to dislodge remaining portions of shive left on the fibers without damage to the fibers. Utilizing the scutching unit can increase fiber purity up to around 80 percent. Field retting of the straw and exercising control over the straw moisture content can also assist in increasing fiber purity. Adjustment of the roller spacing and speed of the machine 10 can also help in obtaining higher purity percentages.

For determining fiber purity, a twenty (20) gram sample can be taken from the processed fiber. The sample can then be ground in 2 mm lengths in a Willey Grinding Mill. The ground sample is weighed and placed in a mini-cyclone separator. A vacuum cleaner is used to provide air flow for separating shive and fiber and as the sample is mixed, fiber is separated by way of air classification. As the shive particles are heavier, they remain in the mixer with the fiber being carried by the air flow and removed from the flow by a mini-cyclone and routed to a different sample container. After removal of fiber from the shive, the remaining shive is weighed and a purity percentage of fiber is calculated using the weight of the measured weight of the shive and the sample weight.

As previously mentioned, it is preferred that the feed rollers 24 are operated at a predetermined operating speed that is lower than the predetermined operating speed for the intermediate speed rollers 26 which, in turn, is lower than the predetermined operating speed for the high speed rollers 28. In this manner, flax 20 is pulled from between the bending region **18*a* between the feed rollers 24*a* and 24*b* to the bending region 18*b* between the intermediate speed rollers 26*a* and 26*b*. Similarly, the flax 20 is pulled from the bending region 18*b* between the intermediate speed rollers 26*a* and 26*b* to the bending region 18*c* between the high speed rollers 28*a* and 28*b*. Preferably, the feed rollers are rotated at a rate of approximately 60–110 rpm, the intermediate speed rollers 26** at a rate of approximately 1000–1750 rpm, and the high speed rollers at a rate of approximately 2000–3500 rpm to achieve the pulling and stripping action between sets of roller assemblies 14.

Thus, it is apparent that flax material 20 introduced to the roller assemblies 14 will be bent in a back and forth fashion in the bending regions 18 over and between the surfaces of the flutes 22 of roller assemblies 14 which will produce areas of weakness in the exterior woody shive material of the flax 20. Then, as the flax 20 is caused to be pulled between sets of rollers 14, the woody shive material will tend to dislodge from the fiber at the areas of weakness thus stripping the shive from the flax fibers. In addition, as the flax 20 will tend to be reoriented as it is fed between the roller assemblies 14 through the bending regions 18 to travel in a transverse direction across the flutes 22, in other words, so that the flax straw 20 is arranged lengthwise in a direction normal to the axes of the roller assemblies 14, the pulling force between sets of roller assemblies 14 will act on the fibers along their length where the fiber has its most strength, thus limiting any damage or breaking of the fibers tending to shorten the fiber length. Moreover, the fibers are sufficiently flexible so as to bend around the flutes 22 without tearing such as can occur when they are subjected to a beating or flailing action or impacted with a sharp edge as in many prior decorticating methods.

As described earlier, the flax straw 20 will tend to orient itself so that it travels along its length in a direction substantially normal to the axis of the roller assemblies 14. In some applications, it may be desirable to provide a set of crush rollers 32 before the processing sections to form a flax straw mat and to provide protection against foreign objects. The crush rollers 32 are driven by a crush roller drive 33 and can be spring loaded together to define a mat forming nip area 34 therebetween so that when flax straw 20 is introduced to the nip area 34, a thin straw mat will be produced and the shive material will be compressed to make it more brittle and prone to breakage as it is fed through the bending regions 18. The machine 10 utilizing elongate roller assemblies 14 can handle increased processing rates of flax straw 20, e.g., 10,000 lbs./hr., versus other methods used by prior decorticating machines. After the flax material 20 has been fed through the processing sections and scutching unit 30, the fiber is collected and can be shaken to remove any loose shive whereupon it is then ready for baling.

Figure 5A:
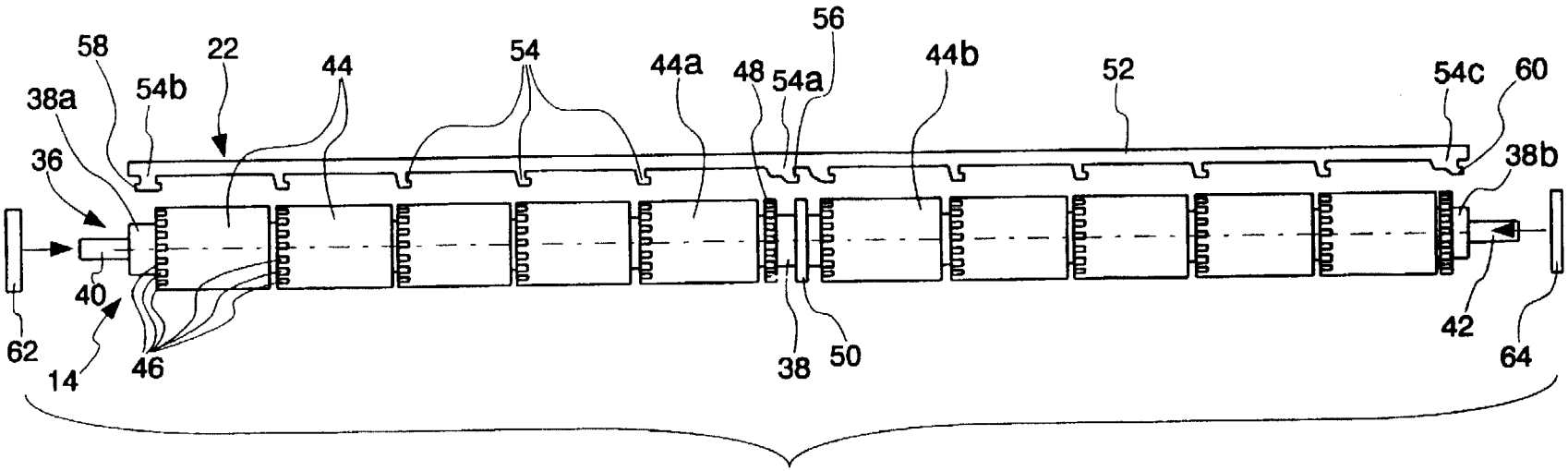
FIG. 5A is a front elevational view of one of the roller assemblies and a removable flute before it is mounted to the roller.
Figure 5B:
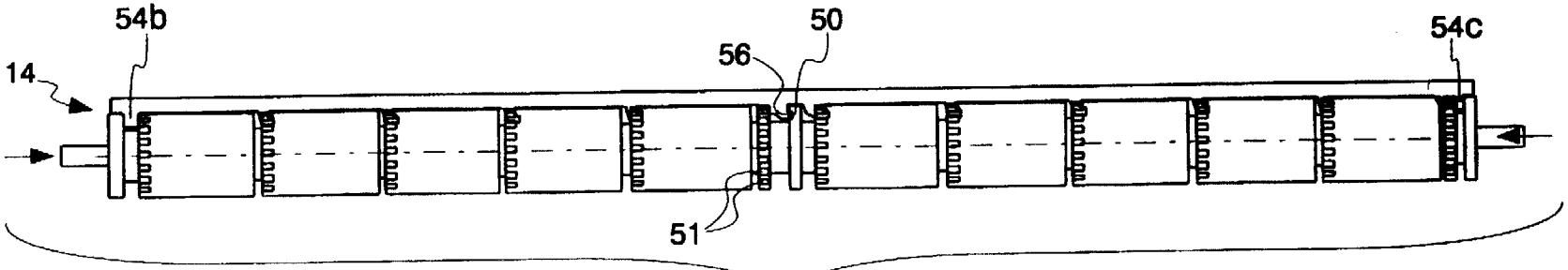
FIG. 5B is a view similar to FIG. 5A with the flute attached to the roller.

Turning to FIGS. 5A and 5B, the preferred construction of the roller assemblies 14 will now be described. While the preferred assembly of the flutes 22 is described herein, it will be manifest that many other means for forming the roller assemblies 14, including their flutes 22 could be utilized. The roller assemblies 14 can each have a shaft 36 having an enlarged diameter cylindrical mounting portion 38 with smaller diameter stub shaft portions 40 and 42 extending from either end **38*a* and 38*b* thereof. On the cylindrical mounting portion 38, a number of short cylindrical spacer members 44 are mounted as by welding. The spacer members 44 are each provided with notches or slots 46 formed in one end face at their outer periphery. In addition, a pair of annular discs 48 and 50 are mounted between the innermost spacer members 44*a* and 44*b* on the cylindrical mounting portion 38 approximately mid-way between either end 38*a* and 38*b* thereof. The annular disc 48 includes locating slots 51 which extend from the outermost periphery radially inwardly towards the center. The disc 50 includes capturing apertures (not shown) which are spaced around the annular body of the disc 50 and in alignment with the slots 51 of disc 48**.

The flutes 22 each include an elongate portion 52 which extends substantially along the entire length of the large diameter mounting portion 38. Depending from the bottom edge of the elongate portion 52 are a plurality of flange hooks 54 which fit into the peripheral slots 46 of the spacer members 44. To fix the circumferential position of the flutes 22, the central flange hook **54*a* is provided with a lowered tab 56 which can be slid into one of the apertures in annular disk 50, as seen in FIG. 5B. Similarly, the end flanges 54*b* and 54*c* can be provided with respective tabs 58 and 60 for mounting in apertures (not shown) of end locking caps 62 and 64, respectively. In one form, the end caps 62 and 64 are welded to the ends 38*a* and 38*b* of the cylindrical mounting portion 38. In another form, the end caps 62 and 64 are press fit or threaded on the ends 38*a* and 38*b*. In this manner, the flutes 22 can be removably secured onto the spacer members 44 providing roller assemblies 14 with a plurality of circumferentially spaced flutes 22 which can be removed once worn and replaced with new flutes 22**.

Figure 6:
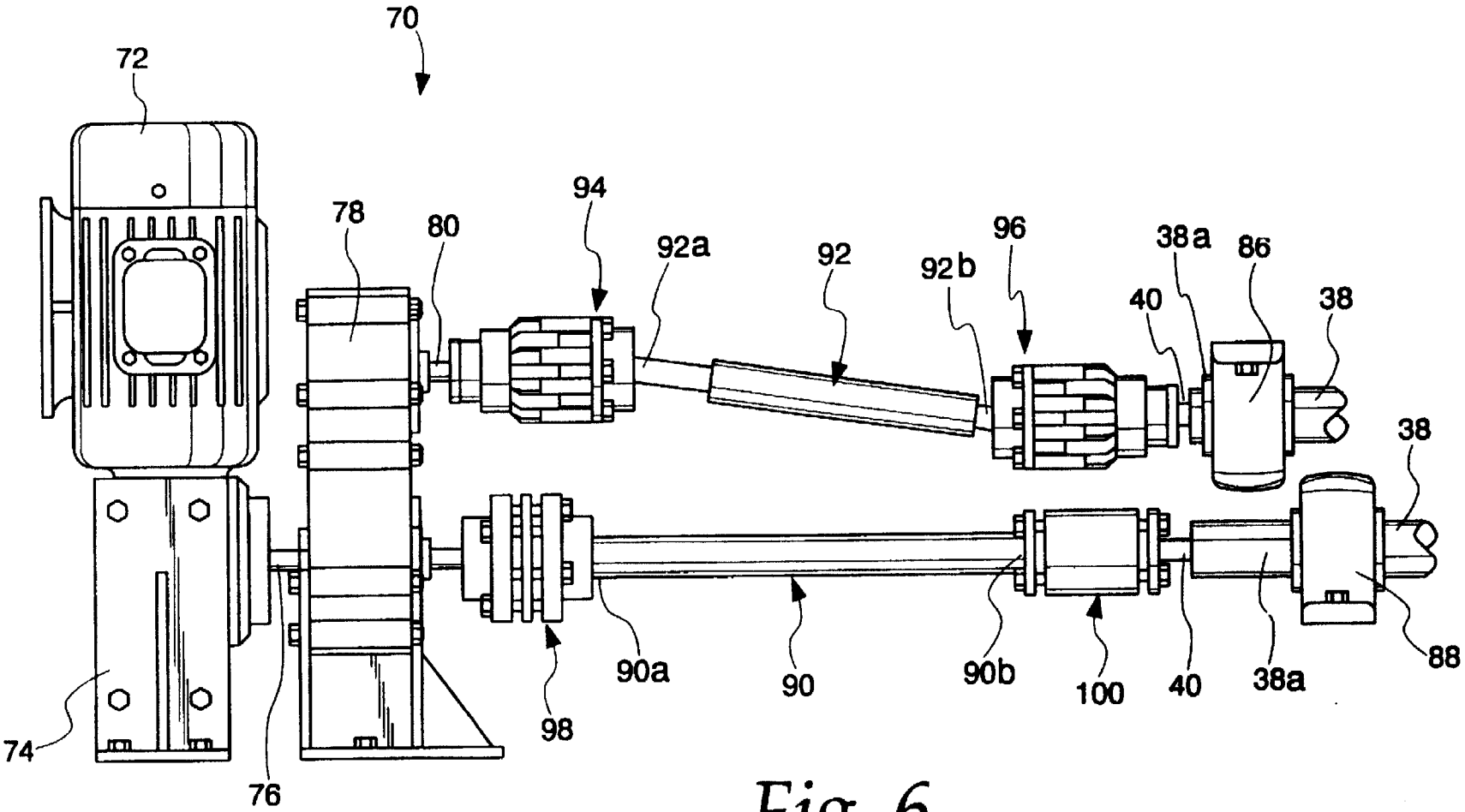
FIG. 6 is a front elevational view of the drive system for one of the sets of feed rollers.

As previously mentioned, the roller assemblies 14 include respective drives 16. As shown in FIG. 1, the drives 16 are mounted on drive mounting platforms 66 and 68 of the framework 12 on either side of the roller assemblies 14. More specifically and referring to FIG. 6, a feed roller assembly drive system 70 is shown including a motor 72 mounted atop a speed or gear reducer housing 74. A drive shaft 76 extends from the housing 74 into gearing housing 78 in which gearing (not shown) is provided for transmitting the rotary power from the drive shaft 76 to opposite or counter rotary motion of a counter shaft 80 to be imparted to upper feed roller **24*a***.

The framework 12 includes upper and lower mounting beams 82 and 84 extending lengthwise on either side of the sets of roller assemblies 14. The ends **38*a* of the cylindrical mounting portions 38 of the shafts 36 are mounted in bearing housings with upper bearing housing 86 attached to the upper beam 82 and lower bearing housing 88 attached to the lower beam 84**.

To drive the upper and lower feed rollers **24*a* and 24*b* with opposite rotary motion and at the same speed so as to move their respective flutes 22 through the bending region 18 defined in the overlap area of the flutes 22 and thereby bend and pull on the flax straw 20 fed therethrough, the drive shaft 76 and counter shaft 80 are coupled to respective intermediate shafts 90 and 92 which, in turn, are coupled to the stub shafts 40 of the lower feed roller 24*b* and the upper feed roller 24*a*, respectively. Due to the relatively small diameters of the feed rollers 24 and the larger displacement between the drive shaft 76 and counter shaft 78, the counter shaft 80 is offset from the axis of the upper roller 24*a* which it drives. In other words, the counter shaft 80 is displaced vertically higher from the axis of the upper roller 24*a*, and therefore, the intermediate shaft 92 is inclined downwardly from the counter shaft 80 to the stub shaft 40 of the upper roller 24*a*. Since it is important that the rollers 24*a* and 24*b* rotate with equal speeds in opposite directions, the intermediate shaft 92 is coupled at respective ends 92*a* and 92*b* thereof to the counter shaft 80 and the stub shaft 40 of the upper roller 24*a* by way of flexible couplings that are CV or constant velocity joints 94 and 96, respectively, as are known. On the other hand, the drive shaft 76 is aligned and coaxial with the shaft of the lower feed roller 24*b* so that more rigid couplings 98 and 100 can be used between the drive shaft 76 and one end 90*a* of the intermediate shaft 90 and the other end 90*b* of the intermediate shaft 90 and the stub shaft 40 of the lower roller 24*b***.

The drive system 102 for the intermediate and high speed rollers 26 and 28 are mounted on the frame platform 68 on the opposite side of the roller assemblies 14. Motors 104 for the intermediate and high speed rollers 26 and 28 are substantially the same and the motors 104 for the intermediate speed rollers 26 are arranged in staggered relation from the motors 104 for the high speed rollers 28 on the frame platform 68. Otherwise, the remainder of the drive system 102 is substantially identical for either the intermediate speed rollers 26 or high speed rollers 28 so that only the drive system for the intermediate speed rollers 26 will be described herein.

Figure 7:
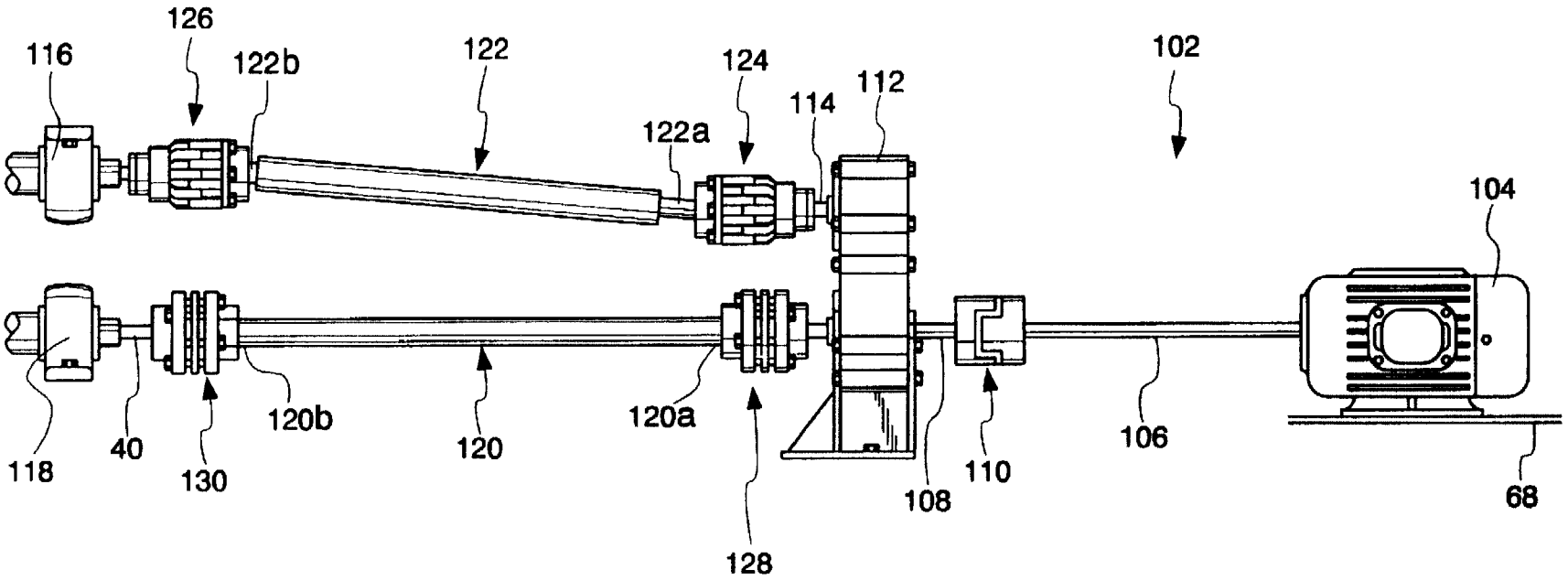
FIG. 7 is a front elevational view of the drive system for one of the sets of intermediate or high speed rollers.

Referring to FIG. 7, the motor 104 is arranged horizontally on the platform 68 with its drive shaft 106 coupled to secondary shaft 108 by way of shaft coupling 110. The secondary drive shaft 108 drives gears (not shown) in gear housing 112 to transmit the rotary power from the drive shaft 106 to counter rotary motion of counter shaft 114 which is imparted to upper intermediate rollers 26*a*.

Similar to the ends 38*a* of the mounting portion 38 of the shafts 36 on the side of the feed roller drive system 70 which are supported in bearing housings 86 and 88, the other ends 38*b* of the mounting portion 38 of the shaft 36 on the side of the intermediate and high speed drive systems 102 are supported in upper and lower bearing housings 116 and 118, respectively.

The following is a description of the drive system 102 and shafting for the intermediate speed rollers 26 (which is substantially the same as that of the high speed rollers 28), with the differences from the feed roller drive system 70 and shafting being due to the difference in diameters between the feed rollers 24 and the intermediate and high speed rollers 26 and 28 and the speeds at which they are driven. To drive the upper and lower intermediate speed rollers 26*a* and 26*b* with opposite rotary motion and at the same speed so as to move their respective flutes 22 through the bending regions 18*b* defined in the overlap areas of the flutes 22 and thereby bend and pull on the flax straw 20 fed therethrough, the secondary drive shaft 108 and counter shaft 114 are coupled to respective intermediate shafts 120 and 122 which, in turn, are coupled to the stub shafts 40 of the lower intermediate speed rollers 26*b* and the upper intermediate speed rollers 26*a*, respectively. Due to the larger diameters of the intermediate speed rollers 26 and the smaller displacement between the secondary shaft 108 and counter shaft 114, the counter shaft 114 is offset from the axis of the upper rollers 26*a* which it drives. In other words, the counter shaft 114 is displaced vertically lower from the axis of the upper roller 26*a*, and therefore, the intermediate shaft 122 is inclined upwardly from the counter shaft 114 to the stub shaft 40 of the upper roller 26*a*. Since it is important that the rollers 26*a* and 26*b* rotate with equal speed in opposite directions, the intermediate shaft 122 is coupled at respective ends 122*a* and 122*b* thereof to the counter shaft 114 and the stub shaft 40 of the upper rollers 26*a* by way of flexible couplings that are CV or constant velocity joints 124 and 126, as are known. On the other hand, the secondary shaft 108 is aligned and coaxial with the shaft of the lower intermediate speed roller 26*b* and high speed roller 28*b* so that more rigid couplings 128 and 130 can be used between the secondary shaft 108 and one end 120*a* of the intermediate shaft 120 and the other end 120*b* of the intermediate shaft 120 and the stub shaft 40 of the lower rollers 26*b* and 28*b*.

While there have been illustrated and described particular embodiments of the present invention, it will be appreciated that numerous changes and modifications will occur to those skilled in the art, and it is intended in the appended claims to cover all those changes and modifications which fall within the true spirit and scope of the present invention.

We claim:

1. A method for separating woody material from plant fibers, the method comprising the steps of:

providing a plurality of woody material bending regions having upper bending and pulling surfaces and lower bending and pulling surfaces;

moving the upper and lower bending and pulling surfaces through the bending regions so that they are in overlapping relation with each other with the upper and lower surfaces moved through their respective regions at the same rate;

feeding plant material to a first one and then a second one of the bending regions;

engaging the plant material with the bending and pulling surfaces in the first region as they move through the first region and with the bending and pulling surfaces in the second region as they move through the second region to move the plant material through the regions;

causing the first and second region bending and pulling surfaces to move through their respective regions at different operating speeds with the surfaces of the first region moving through the first region at a slower speed than the speed at which the surfaces of the second region move through the second region;

gripping and bending the plant material with the slower moving bending and pulling surfaces in the first region;

pulling on the plant material gripped by the first region surfaces with the faster moving second region surfaces to pull the plant material from the first region to the second region; and stripping the woody material from the fibers as an incident of said gripping and pulling of the plant material with the first and second region upper and lower bending and pulling surfaces as they move in overlapping relation through their respective regions at different operating speeds.

2. The method of claim 1 wherein the step of providing bending regions comprises the step of providing first and second sets of fluted rollers having bending and pulling radially extending flute surfaces, and wherein plant material is fed to the first bending region between the first set of fluted rollers and then the second bending region between the second set of fluted rollers.

3. The method of claim 2 wherein the step of separating fibers from woody material includes the step of causing the plant material to undergo back and forth bending and pulling as the bending and pulling flute surfaces engage the plant material as they move through their respective bending regions to crimp and break the woody material and to strip the woody material from the plant fibers.

4. The method of claim 1 further comprising the steps of feeding plant material to a third one of the bending regions after it has moved through the second bending region, engaging the material with the bending and pulling surfaces in the third region as they move through the third region to move plant material through the third region, causing the third region bending and pulling surfaces to move through the third region at an operating speed different than the operating speeds at which the first and the second region bending and pulling surfaces move through their respective regions, and separating fibers from woody material as incident of said engagement of the plant material with the third region bending and pulling surfaces as they move through the third region at their different operating speed.

5. The method of claim 4 wherein the bending and pulling surfaces are caused to move through the first, second and third bending regions at progressively increasing operating speeds.

6. A method for separating woody material from plant fibers, the method comprising the steps of:

providing a plurality of woody material bending regions;

moving bending and pulling surfaces through the bending regions;

feeding plant material to a first one and then a second one of the bending regions;

engaging the plant material with the bending and pulling surfaces in the first region as they move through the first region and with the bending and pulling surfaces in the second region as they move through the second region to move the plant material through the regions;

causing the first and second region bending and pulling surfaces to move through their respective regions at different operating speeds to pull on the plant material with the bending and pulling surfaces;

separating fibers from woody material as an incident of said engagement and pulling of the plant material with the first and second region bending and pulling surfaces as they move through their respective regions at different operating speeds; and feeding plant material to a third one of the bending regions after it has moved through the second bending region, engaging the material with the bending and pulling surfaces in the third region as they move through the third region to move plant material through the third region, causing the third region bending and pulling surfaces to move through the third region at an operating speed different than the operating speeds at which the first and the second region bending and pulling surfaces move through their respective regions, and separating fibers from woody material as incident of said engagement of the plant material with the third region bending and pulling surfaces as they move through the third region at their different operating speed, wherein the bending and pulling surfaces are caused to move through the first, second and third bending regions at progressively increasing operating speeds, and the first, second and third bending regions are provided together as a first plant material processing section and further including the steps of providing additional processing sections identical to the first plant material processing section and feeding the plant material successively to each of the processing sections.

7. The method of claim 6 wherein the plant material is fed through five processing sections at a rate of at least 10,000 pounds per hour and yielding a product from the final processing section in the range of 55 to 60 percent fiber purity.

8. A method for decorticating shive from flax straw to yield flax fibers, the method comprising the steps of:

providing sets of upper and lower fluted rollers with the upper and lower rollers arranged in a set to provide an area therebetween where the flutes of the upper rollers overlap with the flutes of the lower rollers as the rollers are rotated;

rotating the upper and lower fluted rollers in a set at the same predetermined rotation rate;

rotating different sets of fluted rollers at different predetermined rotation rates;

feeding flax straw to the flute overlap areas between the upper and lower rollers;

bending and gripping the shive of the flax in the flute overlap areas by engagement with the roller flutes while limiting damage to the flax fibers; and pulling bent and gripped shive from one set of rollers to the next as a result of the sets different rotation rates to strip the bent shive from the flax and produce flax fibers without beating of the flax and consequent shortening of the flax fibers produced.

9. The method of claim 8 wherein the step of providing sets of fluted rollers comprises providing a first set of feed rollers, a second set of intermediate speed rollers and a third set of high speed rollers, and the flax is fed successively from the first set to the second set to the third set of rollers.

10. The method of claim 9 wherein the rotating step comprises rotating the feed rollers at a rate of approximately 60 to 110 revolutions per minute, the intermediate speed rollers at a rate of approximately 1000 to 1750 revolutions per minute, and the high speed rollers at a rate of approximately 2000 to 3500 revolutions per minute.

11. The method of claim 9 further comprising the steps of providing a set of upper and lower crush rollers, feeding the flax to the crush rollers, producing a thinned mat of compressed flax, and feeding the thinned flax mat to the first set of rollers.

12. The method of claim 8 including the steps of providing removable flutes on the fluted rollers and removing worn flutes on the rollers and replacing the removed flutes with new flutes.

* * * * *